US006632012B2

(12) United States Patent
Vogtmann et al.

(10) Patent No.: US 6,632,012 B2
(45) Date of Patent: Oct. 14, 2003

(54) MIXING MANIFOLD FOR MULTIPLE INLET CHEMISTRY FLUIDS

(75) Inventors: Michael R. Vogtmann, Pleasanton, CA (US); Michael S. Wisnieski, Pleasanton, CA (US)

(73) Assignee: Wafer Solutions, Inc., Fremont, CA (US)

( * ) Notice: Subject to any disclaimer, the term of this patent is extended or adjusted under 35 U.S.C. 154(b) by 0 days.

(21) Appl. No.: 09/845,533

(22) Filed: Apr. 30, 2001

(65) Prior Publication Data

US 2002/0141284 A1 Oct. 3, 2002

Related U.S. Application Data

(60) Provisional application No. 60/280,180, filed on Mar. 30, 2001.

(51) Int. Cl.[7] ..... B01F 15/02; B01F 7/00; B24B 57/02

(52) U.S. Cl. ..... 366/177.1; 366/118; 366/181.5; 366/279; 366/289; 366/318; 366/332; 366/348; 451/60; 451/446

(58) Field of Search ..... 366/117, 118, 366/181.5, 279, 289, 318, 332, 336, 342, 343, 348, 177.1; 451/36, 60, 88, 446

(56) References Cited

U.S. PATENT DOCUMENTS

| | | | | |
|---|---|---|---|---|
| 4,054,010 | A | | 10/1977 | Shipman |
| 4,066,943 | A | | 1/1978 | Roch |
| 4,149,343 | A | | 4/1979 | Feldmeier |
| 4,853,286 | A | | 8/1989 | Narimatsu et al. |
| 4,941,293 | A | | 7/1990 | Ekhoff |
| 5,056,971 | A | | 10/1991 | Sartori |
| 5,173,863 | A | | 12/1992 | Martin |
| 5,178,461 | A | * | 1/1993 | Taniguchi ..... 366/332 |
| 5,209,760 | A | | 5/1993 | Wiand |
| 5,494,862 | A | | 2/1996 | Kato et al. |
| 5,549,511 | A | | 8/1996 | Cronin et al. |
| 5,567,503 | A | | 10/1996 | Sexton et al. |
| 5,582,534 | A | | 12/1996 | Shendon et al. |
| 5,679,055 | A | | 10/1997 | Greene et al. |
| 5,679,212 | A | | 10/1997 | Kato et al. |

(List continued on next page.)

FOREIGN PATENT DOCUMENTS

| | | | |
|---|---|---|---|
| EP | 0776030 | A2 | 5/1997 |
| EP | 0940219 | A2 | 9/1999 |
| EP | 1050374 | A2 | 11/2000 |
| JP | 61-152358 | A | 7/1986 |
| JP | 6-295891 | A | 10/1994 |
| JP | 10-146751 | A | 6/1998 |
| JP | 10-242088 | A | 9/1998 |
| JP | 10-256203 | A | 9/1998 |
| WO | WO 99/09588 | A1 | 2/1999 |
| WO | WO 99/31723 | A1 | 6/1999 |

OTHER PUBLICATIONS

Wilmer et al; PGPUBS document 2002/0048213, published Apr. 2002, filed Jul. 2001, based on provisional application filed Jul. 2000.*

(List continued on next page.)

*Primary Examiner*—Joseph Drodge
(74) *Attorney, Agent, or Firm*—Townsend and Townsend and Crew LLP; William F. Vobach

(57) ABSTRACT

Exemplary methods, systems and apparatus are provided for accomplishing mixing of chemistries, such as those used in polishing materials used in semiconductor manufacturing. A manifold is provided that combines chemistries with a mixing element, for example, so that the stability of the chemical solution can be maintained so as to facilitate polishing. The mixing element can be oriented in a stationary position, or alternatively, it can be agitated.

17 Claims, 10 Drawing Sheets

U.S. PATENT DOCUMENTS 5,697,832 A 12/1997 Greenlaw et al.
5,733,175 A 3/1998 Leach
5,735,731 A 4/1998 Lee
5,755,614 A * 5/1998 Adams et al. ..... 451/60
5,800,725 A 9/1998 Kato et al.
5,820,449 A 10/1998 Clover
5,821,166 A 10/1998 Hajime et al.
5,827,779 A 10/1998 Masumura et al.
5,830,045 A 11/1998 Togawa
5,842,910 A 12/1998 Krywanczyk et al.
5,849,636 A 12/1998 Harada et al.
5,851,664 A 12/1998 Bennett et al.
5,851,924 A 12/1998 Nakazawa et al.
5,855,735 A 1/1999 Takada et al.
5,865,578 A 2/1999 Benedikter
5,879,222 A 3/1999 Robinson
5,880,027 A 3/1999 Hajime et al.
5,899,743 A 5/1999 Kai et al.
5,913,712 A 6/1999 Molinar
5,941,759 A 8/1999 Kitajima et al.
5,942,445 A 8/1999 Kato et al.
5,951,374 A 9/1999 Kato et al.
5,963,821 A 10/1999 Kai et al.
5,964,646 A 10/1999 Kassir et al.
5,967,882 A 10/1999 Duescher
5,976,260 A 11/1999 Kinoshita et al.
5,980,366 A 11/1999 Waddle et al.
5,981,391 A 11/1999 Yamada
5,985,045 A 11/1999 Kobayashi ..... 451/36
6,036,582 A 3/2000 Aizawa et al.
6,042,459 A 3/2000 Honda
6,046,117 A 4/2000 Bauer et al.
6,050,880 A 4/2000 Kato et al.
6,056,631 A 5/2000 Brown et al.
6,063,232 A 5/2000 Terasawa et al.
6,077,149 A 6/2000 Ohkuni et al.
6,089,963 A 7/2000 Wiand et al.
6,095,897 A 8/2000 Stocker et al.
6,095,904 A 8/2000 Breivogel et al.
6,102,784 A 8/2000 Lichner
6,103,636 A 8/2000 Zahorik et al.
6,114,245 A 9/2000 Vandamme et al.
6,116,987 A 9/2000 Kubo
6,121,111 A 9/2000 Jang et al.
6,132,289 A 10/2000 Labunsky et al.
6,132,294 A 10/2000 Lin
6,149,507 A 11/2000 Lee et al.
6,152,806 A 11/2000 Nystrom
6,156,676 A 12/2000 Sato et al.
6,159,827 A 12/2000 Kataoka et al.
6,162,112 A 12/2000 Miyazaki et al.
6,168,506 B1 1/2001 McJunken
6,183,352 B1 * 2/2001 Kurisawa ..... 451/60
6,184,139 B1 2/2001 Adams et al.
6,184,141 B1 2/2001 Avanzino et al.
6,196,904 B1 3/2001 Matsuo et al.
6,210,259 B1 4/2001 Malkin et al.
6,217,433 B1 4/2001 Herrman et al.
6,220,949 B1 4/2001 Hayashi et al.
6,224,473 B1 5/2001 Miller et al.
6,225,136 B1 5/2001 Lydon et al.
6,227,944 B1 5/2001 Xin et al.
6,227,950 B1 5/2001 Hempel et al.
6,239,039 B1 5/2001 Nihonmatsu et al.
6,270,392 B1 8/2001 Hayashi et al.
6,270,395 B1 8/2001 Towery et al.
6,312,320 B2 11/2001 Sato et al.
6,354,918 B1 3/2002 Togawa et al.
6,358,117 B1 3/2002 Kato et al.
6,358,125 B2 * 3/2002 Kawashima et al. ..... 451/60
6,361,202 B1 * 3/2002 Lee et al. ..... 366/181.5
6,376,395 B2 4/2002 Vasat
6,391,779 B1 5/2002 Skrovan
6,406,364 B1 * 6/2002 Kimura et al. ..... 451/446
6,419,574 B1 7/2002 Takahashi et al.
6,431,959 B1 8/2002 Mikhaylich et al.
6,491,836 B1 12/2002 Kato et al.

OTHER PUBLICATIONS

Vogtmann et al; PGPUBS document 2001/0006882, published Jul. 2001, filed Feb. 2001.*

Systems Dynamics, Inc. web page, www.sysdyn.com/expages/LMIS.htm, May 2, 2001, 2 pages.

GSI Lumonics WaferMark® SigmaXC Nd: YLF–Laser Marking System, www.marwell.se/mls2/15wmsxc.html, May 5, 2001, 2 pages.

Norbert Maurer et al., *High Spped Laser Marking Pen–type Nd: YAG Systems*, SemiconductorFabtech.com Tap Resource, www. fabtech.org/features/tap/articles/02.309.html, May 2, 2001, pp. 1–6.

* cited by examiner

MIXING MANIFOLD FOR MULTIPLE INLET CHEMISTRY FLUIDS

This application claims the benefit of U.S. Provisional Patent Application No. 60/280,180, entitled "Mixing Manifold for Multiple Inlet Chemistry Fluids", filed on Mar. 30, 2001.

This application is related to the following pending U.S. Patent Applications, the complete disclosures of which are incorporated herein by reference:

U.S. patent application Ser. No. 09/808,790, entitled "Cluster Tool Systems and Methods for Processing Wafers," filed on Mar. 15, 2001;

U.S. patent application Ser. No. 09/808,749, entitled "Cluster Tool Systems and Methods for In Fab Wafer Processing," filed on Mar. 15, 2001;

U.S. Provisional Application No. 60/202,495 entitled "Methods to Eliminate Waviness While Grinding As-Cut Semiconductor Substrate Wafer," filed on May 5, 2000; and U.S. patent application Ser. No. 09/808,748, entitled "Cluster Tool Systems and Methods to Eliminate Wafer Waviness During Grindin", filed on Mar. 15, 2001.

BACKGROUND OF THE INVENTION

The general field of technology to which the present invention belongs is wafer manufacture and substrate processing equipment.

Wafers or substrates with exemplary characteristics must first be formed prior to the formation of circuit devices. In determining the quality of the semiconductor wafer, the flatness of the wafer is a critical parameter to customers since wafer flatness has a direct impact on the subsequent use and quality of semiconductor chips diced from the wafer. Hence, it is desirable to produce wafers having as near a planar surface as possible by utilizing polishing and grinding apparatus.

In a current practice, cylindrical boules of single-crystal silicon are formed, such as by Czochralski (CZ) growth process. The boules typically range from 100 to 300 millimeters in diameter. These boules are cut with an internal diameter (ID) saw or a wire saw into disc-shaped wafers approximately one millimeter (mm) thick. The wire saw reduces the kerf loss and permits many wafers to be cut simultaneously. However, the use of these saws results in undesirable waviness of the surfaces of the wafer. For example, the topography of the front surface of a wafer may vary by as much as 1–2 microns ($\mu$) as a result of the natural distortions or warpage of the wafer as well as the variations in the thickness of the wafer across its surface. It is not unusual for the amplitude of the waves in each surface of a wafer to exceed fifteen (15) micrometers. The surfaces need to be made more planar (planarized) before they can be polished, coated or subjected to other processes.

Current substrate polishing technology uses chemical slurry to aid in polishing a substrate. Means for delivering the slurry onto the polishing plate vary for typical chemical mechanical polishing (CMP) techniques. A supplemental alkaline stream is commonly used in addition to the chemical slurry to enhance substrate removal rates during polishing. Unfortunately, one negative side effect of this alkaline stream is that it raises the pH level of the mixture to a level beyond the stability threshold of the silica solution. As a result, colloidal silica particles agglomerate and fall out of the suspension. The particles tend to scratch the wafer during polishing, and in general reduce polishing effectiveness. Hence, improvements are desired to the typical prior art processes.

Additional deficiencies in the current art, and improvements in the present invention, are described below and will be recognized by those skilled in the art.

SUMMARY OF THE INVENTION

In one embodiment of the invention, a manifold for mixing chemistries is provided comprising a plurality of inlets coupled to a manifold interior chamber with each inlet adapted to be coupled to a chemistry line, a mixing element within the chamber, and an outlet coupled to a wafer polishing platen.

The mixing element can take a variety of forms. For example, the mixing element can be shaped, at least partially, in a generally cork screw shape. Furthermore, the mixing element can be a static mixing element. Similarly, an agitator can be used to move the mixing element so as to agitate the mixing element to mix the chemicals.

By injecting the various chemicals into a mixing manifold for near immediate use and delivery to the polishing plate, the present invention reduces or minimizes the time that the chemicals are interacting. As a result, the present invention lessens the time toward instability, which would otherwise occur in the slurry solution.

Other features of the embodiments of the invention will become more fully apparent from the following detailed description, the appended claims, and the accompanying drawings.

DESCRIPTION OF THE SPECIFIC EMBODIMENTS

The wafer shaping process requires multiple chemicals to be delivered to the wafer/pad interface. To reduce the number of chemistry holes entering the polishing platen, a manifold is used to combine the chemistries. The manifold has multiple inlets for coupling to multiple chemistry lines. For example, one inlet and line may be used for each chemical or fluid in the mixture. The manifold has a single output, although in other embodiments can have more than one output. A static mixer element, in one embodiment, is incorporated into the manifold to ensure appropriate mixing of the chemistries. Combining the static mixer element within the manifold, as opposed to in a separate mixer apparatus, reduces the linear distance of travel of the mixed chemistry. Hence, the time the chemicals spend in intimate contact with each other also is reduced. It is advantageous to reduce the time the chemicals are in contact due to the above noted use of a supplemental alkaline steam and the resultant instability in the slurry solution.

By bringing together and thoroughly mixing the several components of the polishing chemistry in a single, compact, low-volume unit, the necessary degree of mixing is achieved while reducing or minimizing the risks associated with excessive chemical interaction time.

Figure 1:
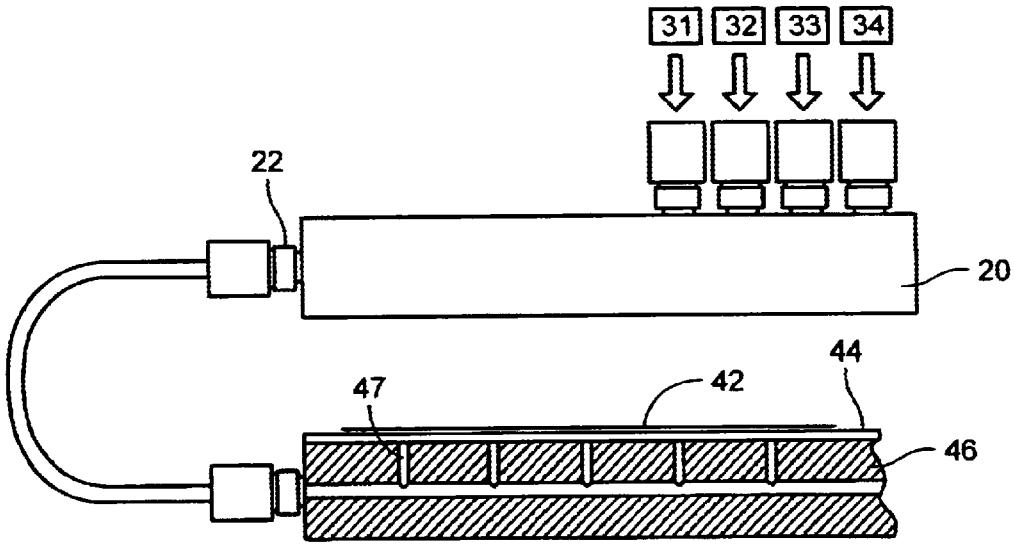
FIG. 1 is a simplified side view of a mixing apparatus and polishing system according to one embodiment of the present invention.

In conjunction with the figures, one embodiment of the present invention will be described. As shown in FIG. 1, water, such as deionized water 34, and one or more chemistries (shown as blocks 31, 32, and 33) are delivered to the mixing manifold 20. In one embodiment, each chemistry is delivered to the mixing manifold by a separate line or tube which is coupled to the manifold with a fitting. Alternatively, two or more chemistries may be premixed and delivered to the manifold together, provided the premixed chemistries are stable and do not cause the colloidal silica particles to agglomerate and fall out of the suspension. The lines are coupled to the manifold with an appropriate number and type of fittings.

The manifold in FIG. 1 is shown coupled to a platen, such as wafer polishing platen 46. The mixed solution can travel through the chemistry tube coupling the manifold and the platen so as to arrive at the internal chamber of the platen. From the internal chamber of the platen, the mixed solution can be supplied via channels (e.g., channel 47) in the platen to the surfacing pad 44. The shaping pad 44 can then utilize the solution, such as in polishing wafer 42.

Figure 2:
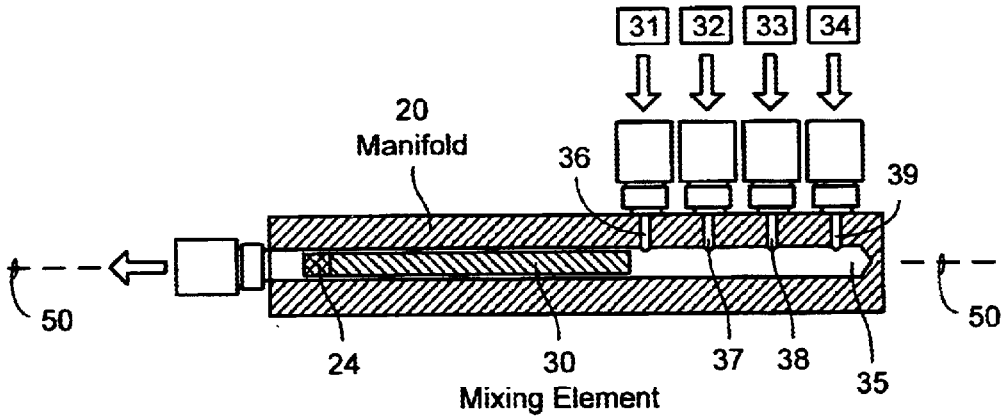
FIG. 2 is a side view of the mixing manifold according to the one embodiment of the invention.

As shown in FIG. 2, chemistries can be introduced near one end of the manifold 20 through inlet channels 36, 37, 38, and 39 into the mixing manifold interior chamber 35. The introduction of the chemistries is adapted so as to cause the chemistries to travel through or past a mixing element 30 to the outlet shown on the left hand side of FIG. 2. The arrow shown in FIG. 2 indicates the direction that the mixed solution would travel in exiting the manifold. By pressurizing the introduction of the chemistries, the chemistries can be used with a static mixing element so as to mix the chemistries into a mixed solution. As will be appreciated by those skilled in the art, more than one outlet and more than one mixing element may be used within the scope of the present invention.

Figure 3:
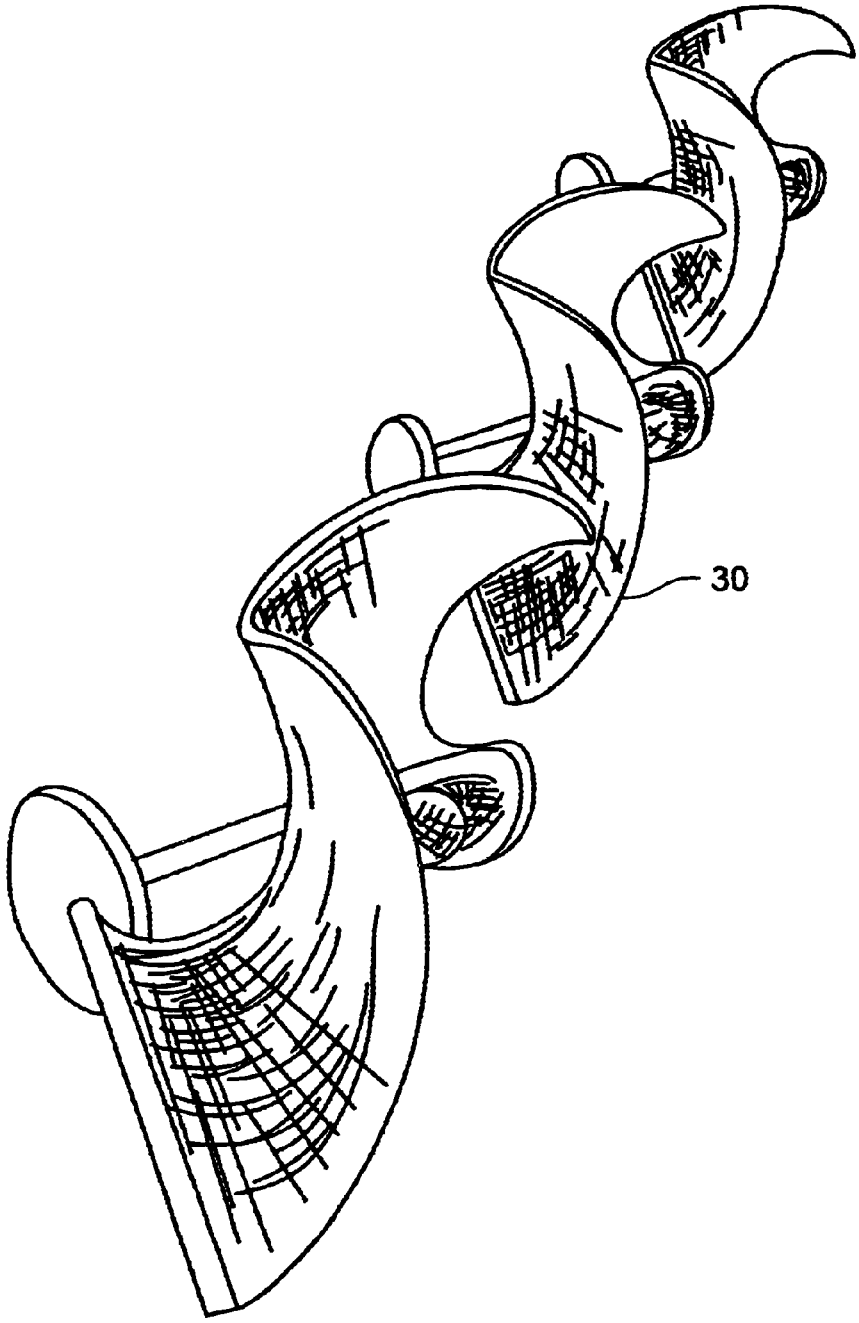
FIG. 3 is an overall view of a mixing element for use in FIG. 2.

One particular embodiment of the mixing element is shown in FIG. 3. The mixing element 30 shown in FIG. 3 is made up of a set of cork screw shaped pieces which mix the multiple chemistries into a single solution. Again, it will be appreciated by those skilled in the art that the exact configuration of the mixing element may vary within the scope of the present invention.

Figure 4:
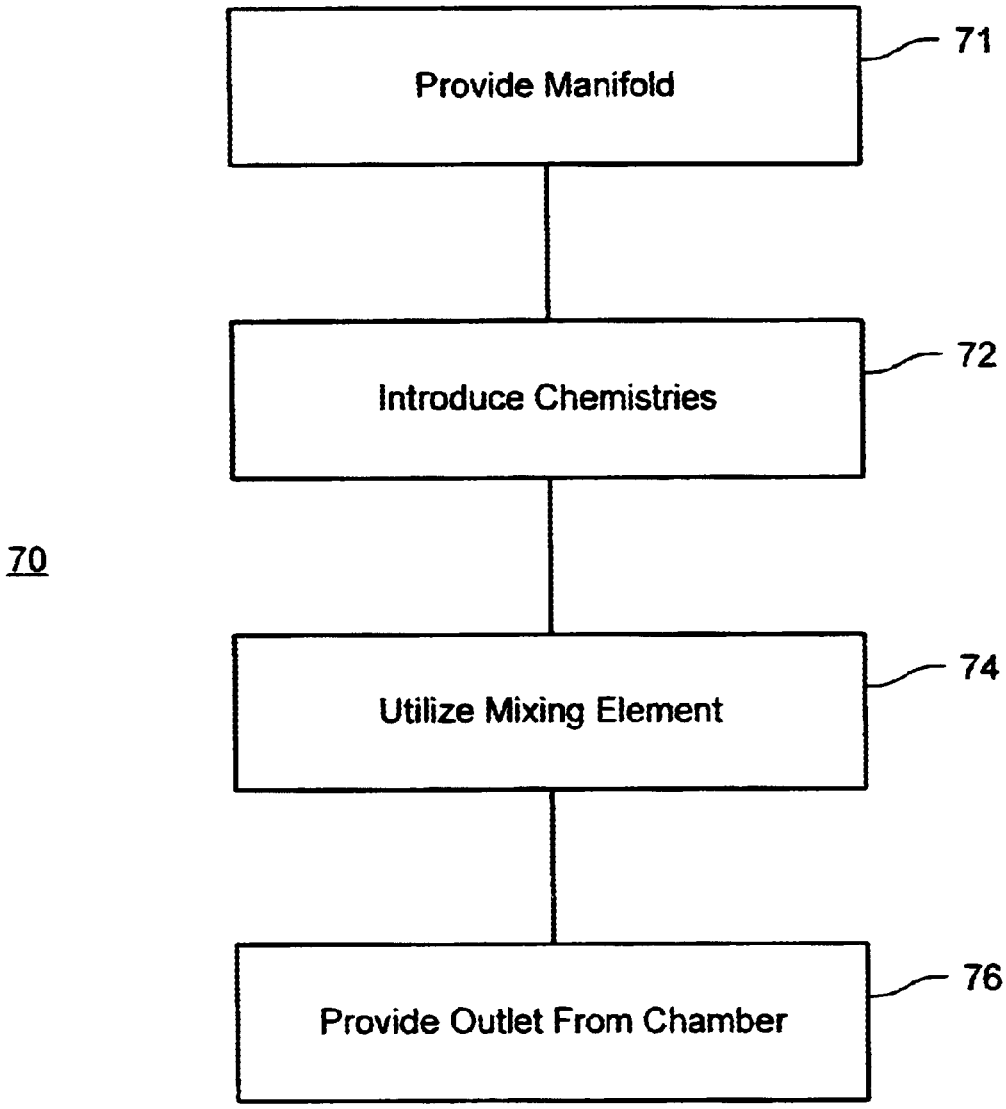
FIG. 4 is a flowchart illustrating a method for implementing one embodiment of the invention.

In FIG. 4, a flowchart is shown illustrating a method 70 for implementing an embodiment of the invention. In block 71, a manifold is provided. Chemistries are introduced to the manifold as shown in block 72. A mixing element is utilized to mix the chemistries as illustrated in block 74. Also, an outlet is provided from the chamber of the manifold as shown in block 76.

In one embodiment of the invention, the mixing element is stationary relative to the interior chamber of the manifold. However, as shown in FIG. 2, an agitator 24 can be coupled to the mixing element to cause the mixing element to move. For example, the mixing element could be translated linearly along an axis, such as the central axis 50 of the interior channel. Alternatively, the mixing element could be rotated about an axis, such as central axis 50. Furthermore, the agitator could be adapted to vibrate the mixing element so as to cause the chemistries to be mixed.

The manifold outlet 22 is coupled to the polishing machine platen in FIG. 1. Polishing of the wafer is accomplished with a shaping pad in one embodiment, with the mixed chemistry delivered to the pad by a series of holes in the platen. In one embodiment, the tube or line connecting the manifold outlet to the platen has a short length. As a result, the present invention reduces the linear distance the different type of chemistries must be in contact with each other before entering the wafer/pad interface. Additionally, the use of one or another small number of manifold outlets reduces the number of fluid connections that must be made to the shaping platen shown in FIG. 2. Still another benefit of one embodiment of the present invention is the reduction in scratches to the wafer otherwise caused by the agglomeration of slurry particles.

In alternative embodiments, the manifold orientation may vary from horizontal to vertical, and the fluid path through the manifold may be generally straight, be criss-cross or have some type of curvature to it. The mixing element may be a replaceable element such that it can be removed from the manifold and replaced with a new element, or a different mixing element. Alternatively, the manifold can be machined such that the mixing element or elements are integrally formed with the manifold.

In still another alternative embodiment, a micro-motor assembly is incorporated into the manifold to mix the chemistries. Alternatively, a vibrational device is incorporated to mix the chemistries. In one aspect, the micro-motor or vibrational device is coupled to the mixing element to rotate, translate, vibrate or otherwise move the mixing element to facilitate chemistry mixing.

As a result, the present invention combines multiple chemistries in a short time and distance from the mixing manifold to the wafer/pad interface. By reducing the time for chemicals to interact, improved polishing and wafer shaping results.

Cluster Tool Systems and Methods

Apparatus and methods described in conjunction with FIGS. 1, 2, 3, and 4 will find use in the cluster tool systems and methods described in conjunction with FIGS. 5, 6A, 6B, 6C, 7, 8A, 8B and 9.

Figure 5:
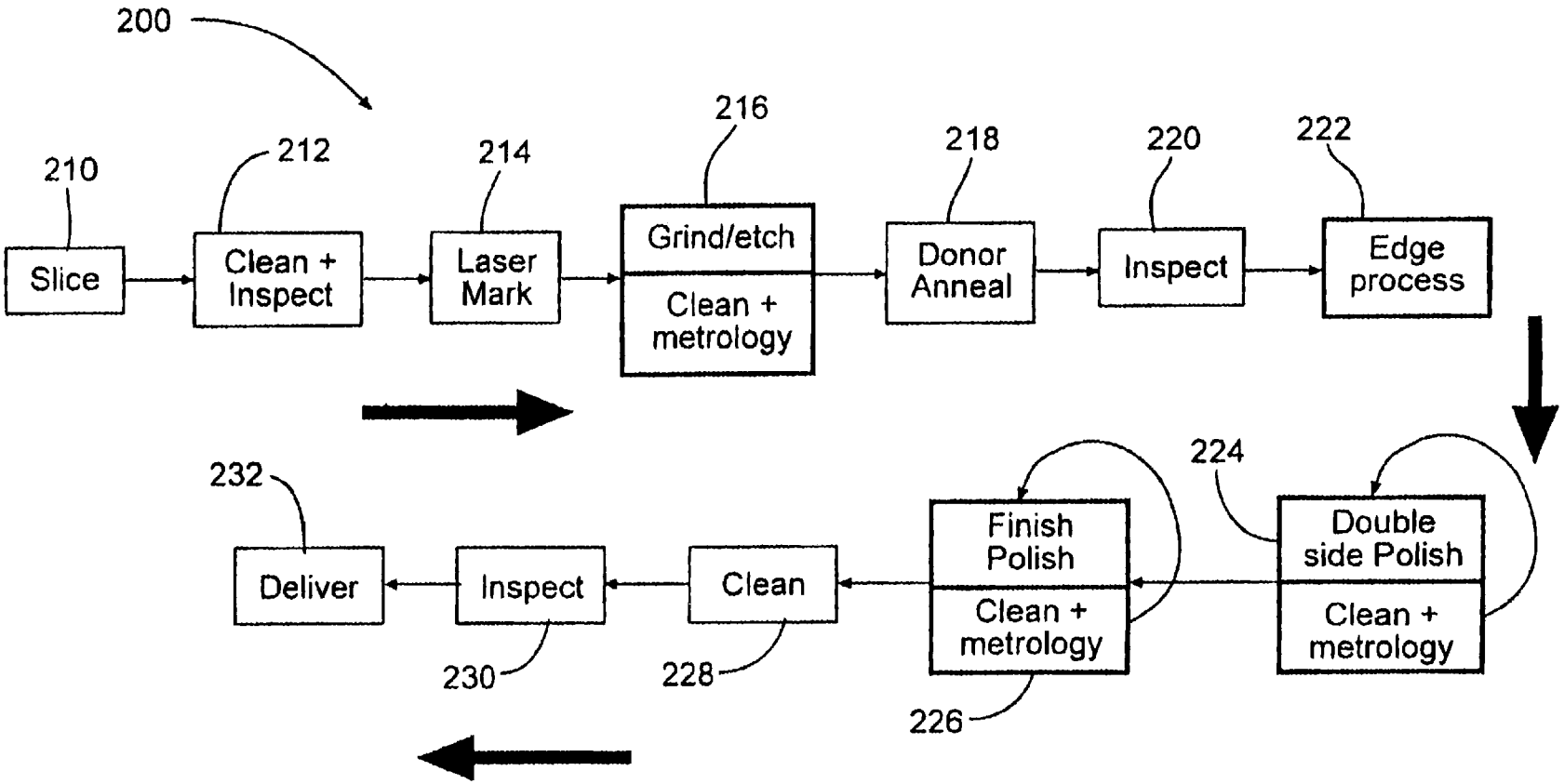
FIG. 5 is a simplified flow diagram of a wafer processing method according to one embodiment of the invention.

FIG. 5 depicts an exemplary method 200 of the present invention. Method 200 includes a slice process 210, using a wire saw, inner diameter saw or the like, to create a generally disc-shaped wafer or substrate. In one embodiment, the wafer is a silicon wafer. Alternatively, the wafer may comprise polysilicon, germanium, glass, quartz, or other materials. Further, the wafer may have an initial diameter of about 200 mm, about 300 mm, or other sizes, including diameters larger than 300 mm.

The wafer is cleaned and inspected (Step 212) and then may, or may not, be laser-marked (Step 214). Laser marking involves creating an alphanumeric identification mark on the wafer. The ID mark may identify the wafer manufacturer, flatness, conductivity type, wafer number and the like. The laser marking preferably is performed to a sufficient depth so that the ID mark remains even after portions of the wafer have been removed by subsequent process steps such as grinding, etching, polishing, and the like.

Thereafter, the wafer is processed through a first module (Step 216), with details of embodiments of the first module described below in conjunction with FIGS. 6A–6C. First module processing (Step 216) includes a grinding process, an etching process, a cleaning process, metrology testing of the wafer, or some combination thereof. In this module, the use of a grinding process in lieu of lapping helps to remove wafer bow and warpage. The grinding process of the present invention also is beneficial in removing wafer surface waves caused by the wafer slicing in Step 210. Benefits of grinding in lieu of lapping include reduced kerf loss, better thickness tolerance, improved wafer shape for polishing and better laser mark dot depth tolerance, and reduced damage, among others.

The etching process within the first module is a more benign process than prior art etch steps. For example, typical prior art etching may involve the bulk removal of forty (40) or more microns of wafer thickness. In contrast, the etch process of the present invention preferably removes ten (10) microns or less from the wafer thickness. In one embodiment, the first module etch process removes between about two (2) microns to about five (5) microns of wafer material per side, or a total of about four (4) to about ten (10) microns. In another embodiment, the first module etch process removes between about three (3) microns and about four (4) microns of wafer material per side for a total of about six (6) to about (8) microns.

After first module processing, the wafer is subjected to a donor anneal (Step 218) and thereafter inspected (Step 220). The donor anneal removes unstable oxygen impurities within the wafer. As a result, the original wafer resistivity may be fixed. In an alternative embodiment, donor anneal is not performed.

The wafer then is processed through a second module (Step 222) in which an edge process is performed. The edge process includes both an edge profile and an edge polish procedure. Edge profiling may include removing chips from the wafer edge, controlling the diameter of the wafer and/or the creation of a beveled edge. Edge profiling also may involve notching the wafer to create primary and secondary flat edges. The flats facilitate wafer alignment in subsequent processing steps and/or provide desired wafer information (e.g., conductivity type). In one embodiment, one or both flats are formed near the ID mark previously created in the wafer surface. One advantage of the present invention involves performing the edge profiling after wafer grinding. In this manner, chips or other defects to the wafer edge, which may arise during grinding or lapping, are more likely to be removed. Prior art edge profiling occurs before lapping, and edge polishing subsequent to the lapping step may not sufficiently remove edge defects.

The wafer is then processed through a third module (Step 224). A third module process includes a double side polish, a cleaning process and wafer metrology. Wafer polishing is designed to remove stress within the wafer and smooth any remaining roughness. The polishing also helps eliminate haze and light point defects (LPD) within the wafer, and produces a flatter, smoother finish wafer. As shown by the arrow in FIG. 5, wafer metrology may be used to adjust the double side polishing process within the third module. In other words, wafer metrology may be feed back to the double side polisher and used to adjust the DSP device in the event the processed wafer needs to have different or improved characteristics, such as flatness, or to further polish out scratches.

Thereafter, the wafer is subjected to a finish polish, a cleaning process and metrology testing, all within a fourth process module (226). The wafer is cleaned (Step 228), inspected (Step 230) and delivered (Step 232).

The reduced number of clean and inspection steps, particularly near the end of the process flow, are due in part to the exemplary metrology processing of the wafer during prior process steps. Wafer metrology testing may test a number of wafer characteristics, including wafer flatness, haze, LPD, scratches and the like. Wafer flatness may be determined by a number of measuring methods known to those skilled in the art. For example, "taper" is a measurement of the lack of parallelism between the unpolished back surface and a selected focal plane of the wafer. Site Total Indicated Reading (STIR) is the difference between the highest point above the selected focal plane and the lowest point below the focal plane for a selected portion (e.g., 1 square cm) of the wafer, and is always a positive number. Site Focal Plane Deviation (SFPD) is the highest point above, or the lowest point below, the chosen focal plane for a selected portion (e.g., 1 square cm) of the wafer and may be a positive or negative number. Total thickness variation (TTV) is the difference between the highest and lowest elevation of the polished front surface of the wafer.

Further, metrology information, in one embodiment, is fed back and used to modify process parameters. For example, in one embodiment metrology testing in the first module occurs after wafer grinding and may be used to modify the grinding process for subsequent wafers. In one embodiment, wafers are processed through the first module in series. More specifically, each station within the first module processes a single wafer at a time. In this manner, metrology information may be fed back to improve the grinding or other process after only about one (1) to five (5) wafers have been processed. As a result, a potential problem can be corrected before a larger number of wafers have been processed through the problem area, thus lowering costs.

Further, the present invention produces standard process times for each wafer. More specifically, each wafer is subjected to approximately the same duration of grinding, cleaning, etching, etc. The delay between each process also is the same or nearly the same for each wafer. As a result, it is easy to troubleshoot within the present invention methods and systems.

In contrast, prior art methods typically uses a batch process mode for a number of process steps. For example, a batch containing a large number of wafers (say, twenty (20)) may be lapped one to a few at a time (say, one (1) to four (4) at a time). After all twenty have been lapped, the batch of twenty wafers then are cleaned together as a group (Step 24), and etched together as a group (Step 26). As a result, the wafers that were lapped first sit around for a longer period of time prior to cleaning than do the wafers lapped last. This varying delay effects wafer quality, due in part to the formation of a greater amount of haze, light point defects, and other time-dependent wafer defects. One negative outcome of irregular process times is the resultant difficulty in locating potential problems within the process system.

As with the first module, metrology information may be fed back within the second, third and fourth modules. For example, metrology information may be fed back to the double side polisher or finish polisher to adjust those processes to produce improved results. Additionally, in one embodiment, metrology information is fed back within the third and/or fourth module in real time. As a result, process steps such as the double side polishing can be modified during processing of the same wafer on which metrology testing has occurred.

Figure 6A:
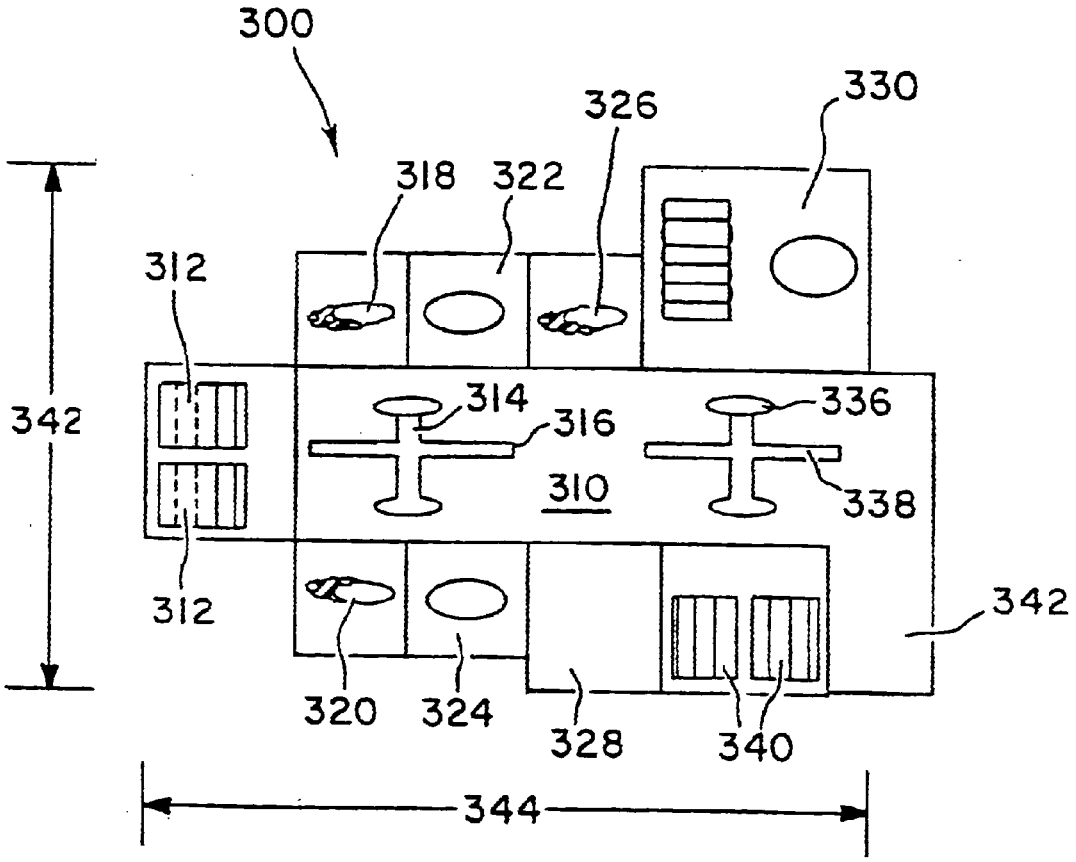
FIGS. 6A, 6B, and 6C depict grind damage cluster tools according to embodiments of the invention.
Figure 6B:
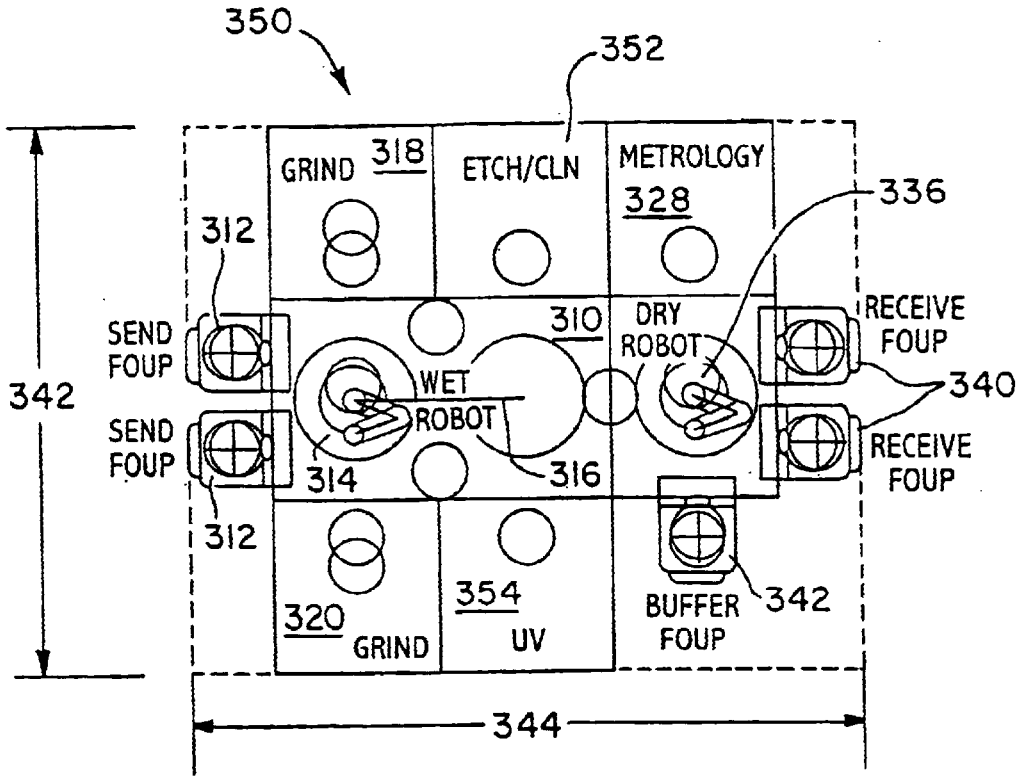
Figure 6C:
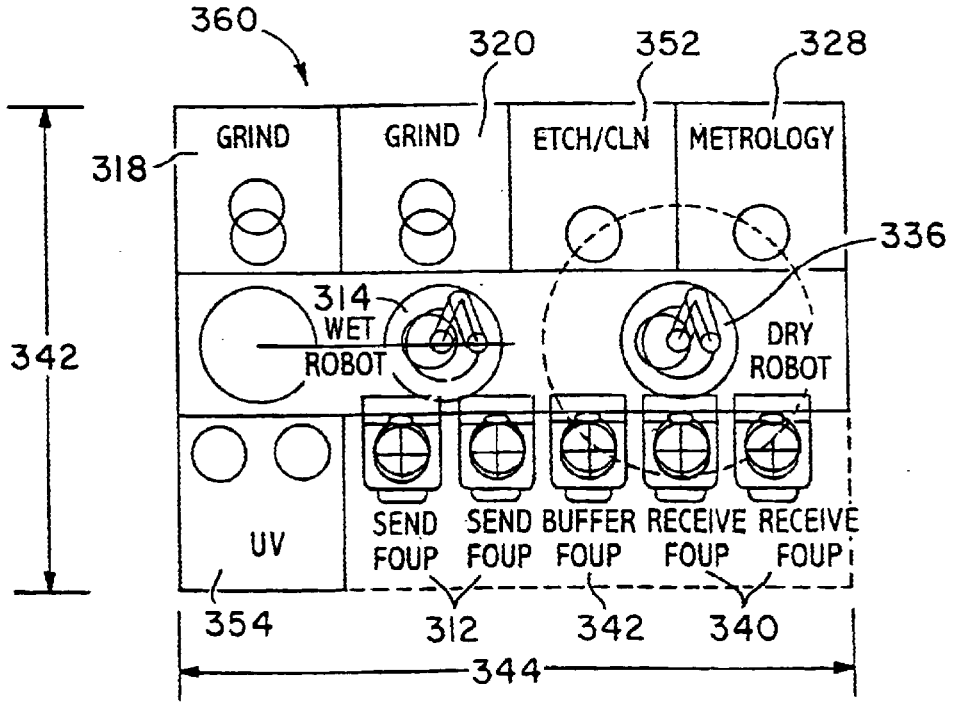

With reference to FIGS. 6A–6C, additional details on grind cluster modules according to the present invention will be provided. It will be appreciated by those skilled in the art that the modules described in FIGS. 6A–C are embodiments of the present invention, from which a large number of variations for each module exist within the scope of the present invention. Further, additional process steps may be removed or added, and process steps may be rearranged within the scope of the present invention. In some embodiments, grinding apparatus 100 as described in conjunction with FIGS. 2–4 are incorporated in the grind clusters of FIG. 6. Details on additional cluster modules are discussed in U.S. application Ser. No. 09/808,790, (Attorney Docket No. 20468-000110), previously incorporated herein by reference.

FIG. 6A depicts a grind damage cluster module described as first module 216 in conjunction with FIG. 5. First module 300 defines a clean room environment 310 in which a series of process steps are carried out. Wafers that have been processed through Step 214 (FIG. 5) are received in first module 300 via a portal, such as a front opening unified pod (FOUP) 312. First module 300 is shown with two FOUPs 312, although a larger or smaller number of FOUPs/portals may be used. FOUPs 312 are adapted to hold a number of wafers so that the frequency of ingress into the clean room environment 310 may be minimized. A transfer device 314, schematically depicted as a robot, operates to remove a wafer from FOUPs 312 and place the wafer on a grinder 318. If needed, transfer device 314 travels down a track 316 to properly align itself, and hence the wafer, in front of grinder 318. Grinder 318 operates to grind a first side of the wafer. In one embodiment, grinder 318 is grinder 100 as described in FIGS. 2A–4.

The wafer may be held down on grinder 318 by way of a vacuum chuck, and other methods. Once grinder 318 has ground the first side of the wafer, the wafer is cleaned in cleaner 322 and the transfer device 314 transfers the wafer back to grinder 318 for grinding the converse side of the wafer. In one embodiment, wafer grinding of both wafer sides removes about forty (40) microns to about seventy (70) microns of wafer thickness. After the second wafer side is ground, the wafer is again cleaned in cleaner 322. In one embodiment, cleaning steps occur on grinder 318 subsequent to grinding thereon. In one embodiment, cleaning and drying are accomplished by spraying a cleaning solution on the wafer held by or near the edges and spun.

In another embodiment, at least one side of the wafer is subjected to two sequential grinding steps on grinder 318. The two grinding processes preferably include a coarse grind followed by a fine grind. Grinder 318 may include, for example, two different grinding platens or pads with different grit patterns or surface roughness. In one embodiment, the wafer is cleaned on grinder 318 between the two grinding steps to the same wafer side. Alternatively, cleaning may occur after both grinding steps to the same wafer side.

In some embodiments, transfer device 314 transfers the wafer from cleaner 322 to a backside polisher 326. For example, this process flow may occur for 200 mm wafers. In this embodiment, the back side is polished and not ground, or both ground and polished.

As shown in FIG. 6A, a second grinder 320 and a second cleaner 324 are provided within module 300. In this manner, two wafers may be simultaneously processed therethrough. Again, in one embodiment second grinder 320 is grinder 100. Since both grinders 318, 320 have a corresponding cleaner 322, 324, wafer processing times are consistent even if two wafers are being ground simultaneously on grinders 318, 320. In one embodiment, grinders 318 and 320 are used to grind opposite sides of the same wafer. In this case, one side of the wafer is ground on grinder 318 and the other side of the same wafer is ground on grinder 320. As with grinder 318, wafers may be ground on grinder 320 and then cleaned on grinder 320 before removal, or cleaned in cleaner 324.

Once the wafers have been ground, a second transfer device 336, again a robot in one embodiment, operates to transfer the wafer to an etcher 330. Etcher 330 operates to remove material from the wafer, preferably a portion on both primary sides of the wafer. The etching process is designed to remove stresses within the silicon crystal caused by the grinding process. Such an operation, in one embodiment, removes ten (10) microns or less of total wafer thickness. In this manner, etcher 330 operates to remove less wafer material than in prior art etch processes. Further, the present invention requires less etchant solution, and hence poses fewer environmental problems related to disposal of the acids or other etchants.

Wafer metrology is then tested at a metrology station 328. In one embodiment wafer metrology is tested subsequent to grinding on grinder 318, and prior to the etching within etcher 330. Alternatively, wafer metrology is tested subsequent to etching in etcher 330. In still another embodiment, wafer metrology is tested both prior to and subsequent to the etching process. Evaluation of wafer metrology involves the testing of wafer flatness and other wafer characteristics to ensure the wafer conforms to the desired specifications. If the wafer does not meet specifications, the wafer is placed in a recycle area 342, which in one embodiment comprises a FOUP 342 (not shown in FIG. 6A). Wafers with acceptable specifications are placed in an out portal or FOUP 340 for removal from first module 300.

As shown and described in conjunction with FIG. 6A, first module 300 provides an enclosed clean room environment in which a series of process steps are performed. Wafers are processed in series through first module 300. Hence, each wafer has generally uniform or uniform process time through the module as well as generally uniform or uniform delay times between process steps. Further, by immediately cleaning and etching the wafer after grinding, the formation of haze and light point defects (LPD) within the wafer are reduced. Such a module configuration is an improvement over the prior art in which wafers are typically processed during the lapping step in batch mode. As a result, some wafers will wait longer before the cleaning or etching steps than others within the same batch. As a result, haze and other wafer defects vary from wafer to wafer, even between wafers within the same batch. Such a shortcoming of the prior art can make it difficult if not impossible to isolate problems within the wafer process flow in the event defective wafers are discovered.

An additional benefit of first module 300 is its compact size. In one embodiment, module 300 has a width 342 that is about 9 feet 3 inches and a length 344 that is about 12 feet 6 inches. In another embodiment, first module 300 has a footprint between about ninety (90) square feet (sqft) and about one hundred and fifty (150) square feet. It will be appreciated by those skilled in the art that the width and length, and hence the footprint of first module 300, may vary within the scope of the present invention. For example, additional grinders 318, 320 may be added within first module 300 to increase the footprint of module 300. In one embodiment, first module 300 is adapted to process about thirty (30) wafers per hour. In another embodiment, first module 300 is adapted to process between about twenty-nine (29) and about thirty-three (33) 300 mm wafers per hour.

FIG. 6B depicts an alternative embodiment of a grind damage cluster module according to the present invention.

Again, the grind damage cluster module 350 may correspond to first module 216 described in conjunction with FIG. 5, and the grinder(s) therein may be grinder 100 as described in FIGS. 2, 3 and/or 4. Module 350 includes many of the same components as the embodiment depicted in FIG. 6A, and like reference numerals are used to identify like components. Module 350 receives wafers or substrates to be processed at portal 312, identified as a send FOUP 312 in FIG. 6B. Wafers are transferred by transfer device 314, shown as wet robot 314, to a preprocessing station 354. In one embodiment, transfer device 314 travels on a track, groove, raised member or other mechanism which allows transfer device 314 to reach several process stations within module 350.

At preprocessing station 354, a coating is applied to one side of the wafer. In one embodiment, a polymer coating is spun on the wafer to provide exemplary coverage. This coating then is cured using ultraviolet (UV) light to provide a low shrink, rapid cured coating on one side of the wafer. In addition to UV curing, curing of the coating may be accomplished by heating and the like. In a particular embodiment, the coating is applied to a thickness between about five (5) microns and about thirty (30) microns.

Once cured, the coating provides a completely or substantially tack free, stress free surface on one side of the wafer. In one embodiment of the present invention, transfer device 314 transfers the wafer to grinder 318, placing the polymer-coated side down on the grinder 318 platen. In one embodiment, the platen is a porous ceramic chuck which uses a vacuum to hold the wafer in place during grinding. The waves created during wafer slicing are absorbed by the coating and not reflected to the front side of the wafer when held down during the grinding process. After the first wafer side is ground on grinder 318, the wafer is flipped over and the second side is ground. As described in conjunction with FIG. 6A, an in situ clean of the wafer may occur before turning the wafer, or the wafer may be cleaned subsequent to grinding of both sides. Again, the second side grinding may occur on grinder 318 or grinder 320. Grinding of the second side removes the cured polymer, and a portion of the second wafer surface resulting in a generally smooth wafer on both sides, with little to no residual surface waves. Additional details on exemplary grinding apparatus and methods are discussed in U.S. application No. 09/808,748, filed on Mar. 15, 2001 and previously incorporated herein by reference.

After grinding on grinder 318 and/or 320, the wafer is transferred to a combined etch/clean station 352 for wafer etch. Again, wafer etching in station 352 removes a smaller amount of wafer material, and hence requires a smaller amount of etchant solutions, than is typically required by prior art processes.

Processing continues through module 350 ostensibly as described in FIG. 6A. The wafer metrology is tested at metrology station 328. Wafers having desired characteristics are transferred by transfer device 336, shown as a dry robot, to out portals 340, identified as receive FOUPS 340 in FIG. 6B. Wafers having some shortcoming or undesirable parameter are placed in a recycle area 342, shown as a buffer FOUP 342, for appropriate disposal.

In one embodiment, module 350 has a width 342 at its widest point of about one hundred and fourteen (114) inches, and a length at its longest point of about one hundred and forty-five inches (145), with a total footprint of about one hundred and fourteen square feet (114 sqft). As will be appreciated by those skilled in the art, the dimensions and footprint of module 350 may vary within the scope of the present invention.

Still another embodiment of a grind damage cluster module according to the present invention is shown in FIG. 6C. FIG. 6C depicts a first module 360 having similar stations and components as module 350 described in FIG. 6B. Module 350 further may incorporate, in some embodiments, grinder 100. However, module 350 is a flow through module, with wafers being received at one end or side of module 350 and exiting an opposite end or side of module 350. Module 360 has FOUPS 312, 342 and 340 grouped together. Such a configuration provides a single entry point into module 360, and hence into clean room environment 310. Transfer devices 314 and 336 again facilitate the movement of wafers from station to station within module 360. As shown in FIGS. 6B and 6C, transfer device 314 travels on mechanism 316, as discussed in conjunction with FIG. 6B. Transfer device 336 operates from a generally fixed position with arms or platens extending therefrom to translate the wafer to the desired processing station. Module 360 further includes station 354 for application of a wafer coating, such as the UV cured polymer coating described above.

Figure 7:
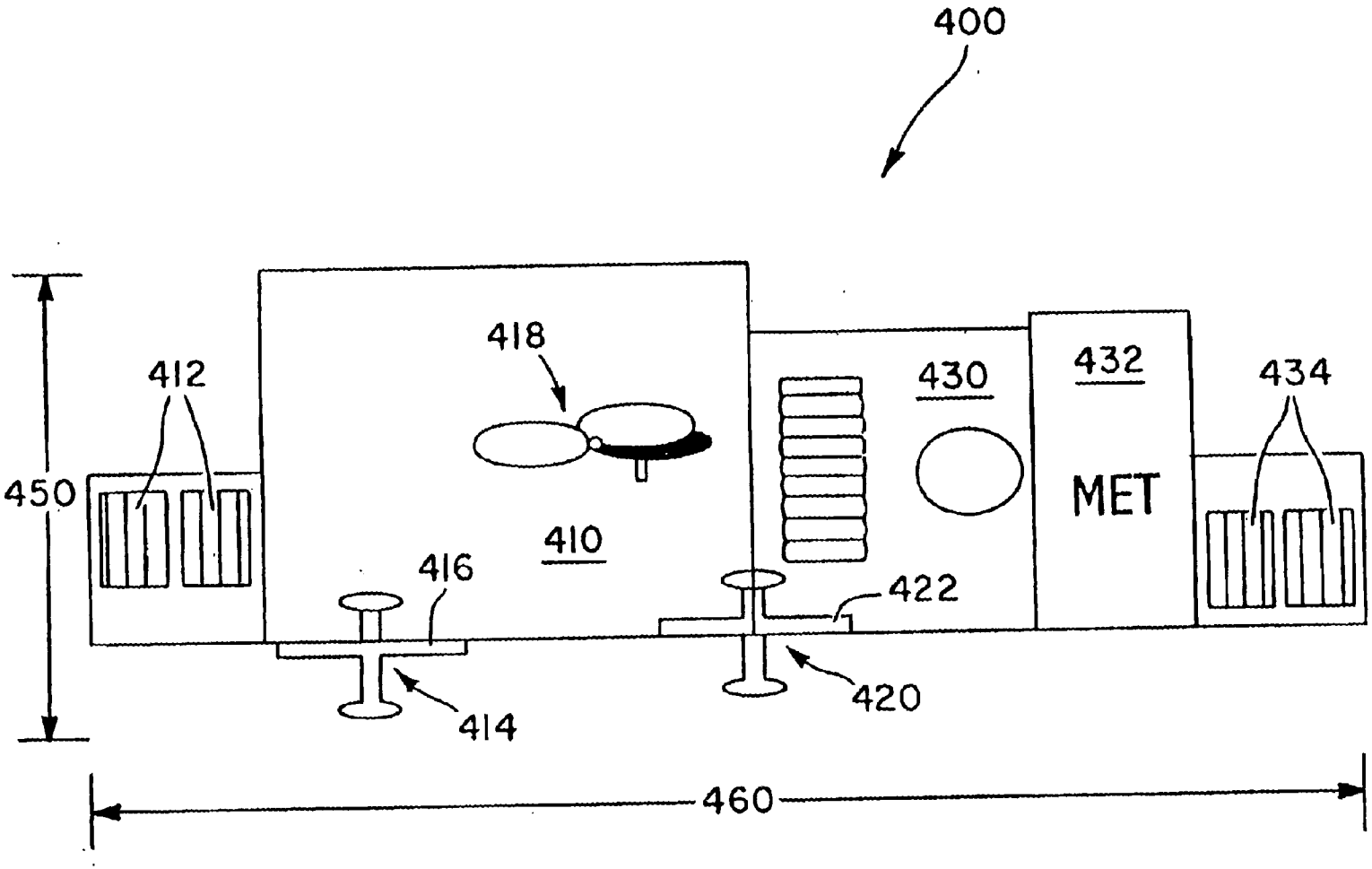
FIG. 7 depicts an edge profile/polish cluster tool according to one embodiment of the invention.

Turning now to FIG. 7, an exemplary second module comprising an edge profile and edge polishing module will be described. Second module 400 again includes a clean room environment 410 to facilitate clean operations. Second module 400 has a portal 412 for receiving wafers to be processed. Again, in one embodiment, portal 412 is one or more FOUPs. A robot or other transfer device 414 operates to take a wafer from portal 412 and transfer the wafer to an edge profiler/polisher 418. Edge profiler/polisher 418 may comprise one device, or two separate devices with the first device for profiling and the second device for polishing. Transfer device 414 may travel down a track 416 to permit proper placement of the wafer in the edge profiler/polisher 418.

The edge of the wafer is profiled and polished as described in conjunction with FIG. 5. In one embodiment, edge profiling removes about ten (10) microns to about fifty (50) microns of material from the diameter of the wafer, with a resultant diameter tolerance of about +/−0.5 $\mu$. After edge profiling and polishing, a transfer device 420 operates to transfer the wafer to a cleaner 430. Again, transfer device 420 may travel on a track 422 to place the wafer in cleaner 430. Cleaner 430 may comprise a mixture of dilute ammonia, peroxide, and water, or an ammonia peroxide solution and soap, followed by an aqueous clean, and the like.

Subsequent to cleaning in cleaner 430, the wafer is transferred to a metrology station 432 at which wafer metrology is examined. An out-portal 434 is positioned to receive wafers having successfully completed processing through second module 400. In one embodiment, portal 434 is a FOUP which collects wafers meeting desired specifications. Again, rejected wafers are set aside in a separate area or FOUP.

Second module 400 has a compact configuration similar to first module. In one embodiment, second module 400 has a width 450 of about 7 feet 6 inches and a length 460 of about 22 feet 11 inches. In another embodiment, second module 400 has a footprint between about ninety (90) square feet (sqft) and about one hundred and fifty (150) square feet. The module 400 shown in FIG. 7 may be used to carry out process step 222 depicted in FIG. 5. In one embodiment, second module 400 processes about thirty (30) wafers per hour. In another embodiment, second module 400 is adapted to process between about twenty-nine (29) and about thirty-three (33) 300 mm wafers per hour. In still another embodiment, second module 400 processing occurs prior to first module 300 processing. In this manner, edge profile and/or edge polish procedures occur before wafer grinding.

Figure 8A:
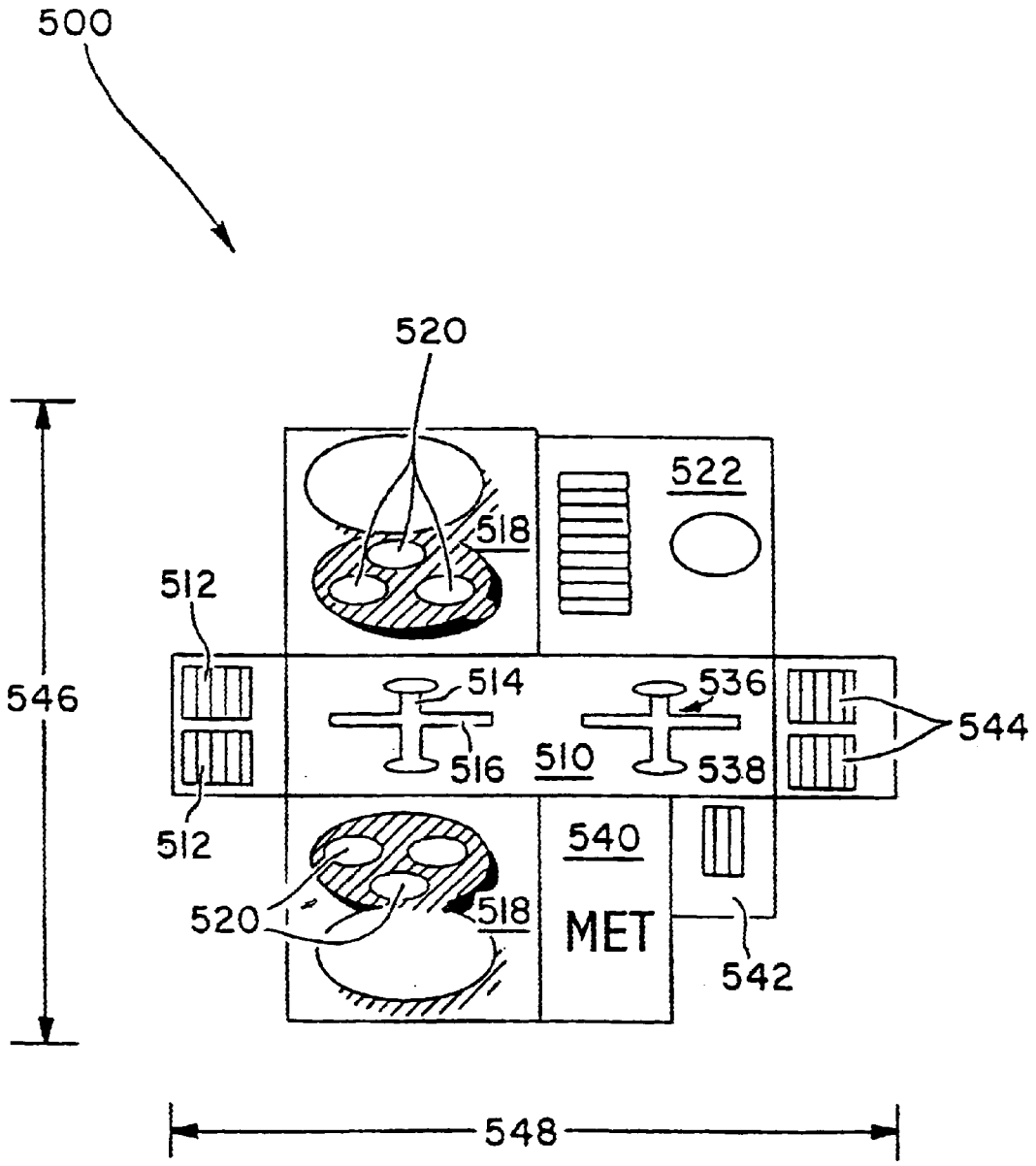
FIGS. 8A and 8B depict double side polish cluster tools according to one embodiment of the invention.

FIG. 8A depicts a third module 500 comprising a double side polisher for use in process step 224 shown in FIG. 5. Module 500 again includes an in-portal 512 which may be one or more FOUPs in one embodiment. Wafers are received in portal 512 and transferred within a clean room environment 510 by a transfer device 514. Transfer device 514, which in one embodiment is a robot, may travel along a track 516 to deliver the wafer to one or more double side polishers (DSP) 518.

As shown in FIG. 8A, double side polisher 518 accommodates three wafers 520 within each polisher. It will be appreciated by those skilled in the art that a greater or fewer number of wafers may be simultaneously polished within DSP 518. Prior art double side polishing (DSP) typically polishes a batch of ten or more wafers at a time in a double side polisher. The polisher initially only contacts the two or three thickest wafers due to their increased height within the DSP machine. Only after the upper layers of the thickest wafers are removed by polishing, are additional wafers polished within the batch. As a result, the batch mode polishing takes longer, and uses more polishing fluids and deionized water than in the present invention.

Hence in one preferred embodiment of the present invention, three wafers are polished simultaneously. Subsequent to polishing on polisher 518, the wafers are transferred via a transfer device 536, traveling on track 538 to a buffer station 522. Thereafter, the wafers are buffed, cleaned and dried. Either prior to or after processing through station 522, or both, wafers are tested at a metrology station 540. For wafers meeting desired specifications, transfer device 536 transfers those wafers to an out-portal 544, again, one or more FOUPs in one embodiment. Wafers which do not meet specifications are placed in a reject FOUP 542.

As with prior modules, the third module 500 has a compact footprint. In one embodiment, module 500 has a width 546 that is about 13 feet 11 inches and a length 548 that is about 15 feet 11 inches. In another embodiment, third module 500 has a footprint between about one hundred (100) square feet (sqft) and about one hundred and eighty (180) square feet. Third module 500 may have a different footprint within the scope of the present invention.

In one embodiment, DSP 518 removes about twelve (12) microns of wafer thickness from both sides combined, at a rate of about 1.25 to 2.0 microns per minute. DSP 518 operates on a twelve (12) minute cycle time per load. Hence, in one embodiment, two DSPs 518 process about thirty (30) wafers per hour. In another embodiment, third module 500 is adapted to process between about twenty-nine (29) and about thirty-three (33) 300 mm wafers per hour. It will be appreciated by those skilled in the art that DSP 518 process times, third module 500 throughput, and other parameters may vary within the scope of the present invention. For example, additional DSPs 518 may be added to increase module 500 throughput. In one embodiment, wafer metrology tested at metrology station 540 is fed back to DSPs 518 to adjust DSP 518 operation as needed to produce desired wafer metrology.

Figure 8B:
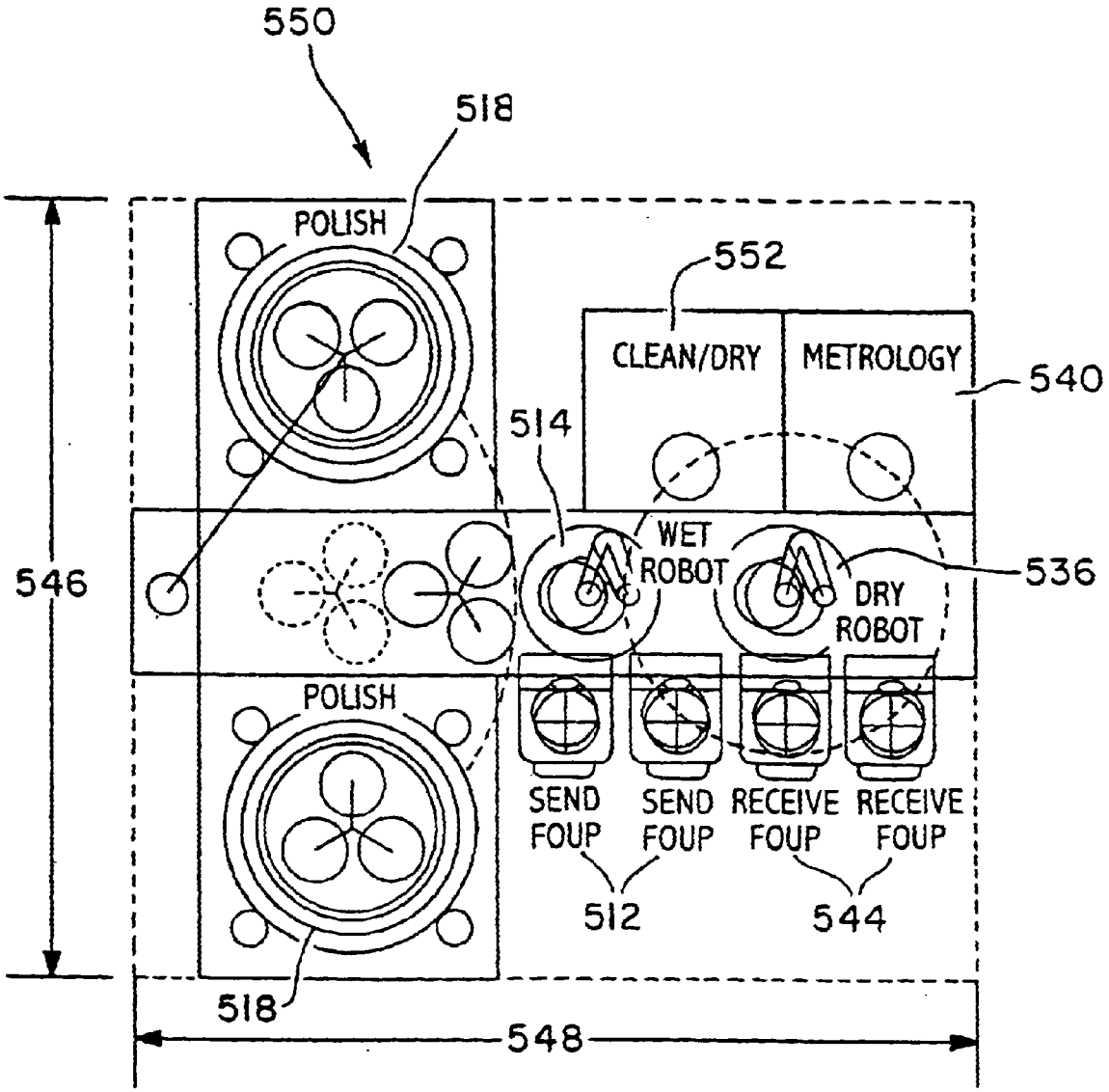

FIG. 8B depicts an alternative embodiment of a third module according to the present invention. As shown in FIG. 8B, third module 550 comprises a double side polisher for use in process step 224 shown in FIG. 5, as well as several other components shown in FIG. 8A. Module 550 includes a clean/dry station 552 for wafer cleaning and drying subsequent to wafer polishing in polisher 518. Transfer devices 514 and 536, shown as a wet robot and a dry robot, respectively, operate to transfer wafers within module 550. In one embodiment, transfer device 514 travels on a track, groove, raised feature or the like to reach several processing stations and portals 512, while transfer device 536 operates from a fixed base.

While module 500 in FIG. 8A is a flow through module, with wafers received by module 500 at one side and exiting from an opposite side, module 550 in FIG. 8B groups portals 512 and 544. Again, such a grouping of in and out portals facilitates access to module 550 from a single point or side. In one embodiment, a buffer or reject FOUPS (not shown) also is grouped with portals 512 and 544. Alternatively, one or more of portals 512 and 544 may operate as a reject FOUPS.

Third module 550, in one embodiment, has a compact footprint with a width 546 at the widest point of about one hundred and forty two (142) inches and a length at the longest point of about one hundred and fifty-five inches (155).

Figure 9:
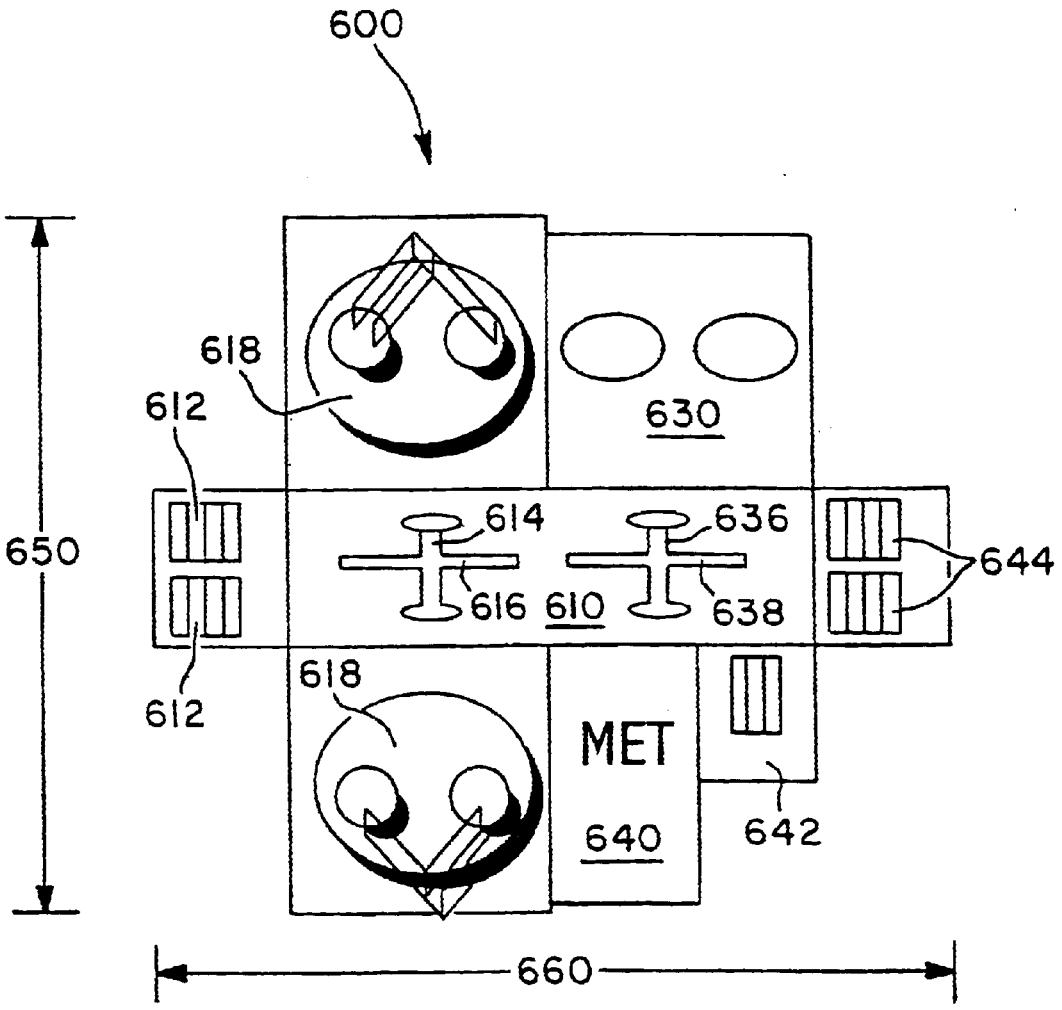
FIG. 9 depicts a finish polish cluster tool according to one embodiment of the present invention.

Turning now to FIG. 9, a fourth module 600, comprising a finish polish cluster, will be described. Fourth module 600 in one embodiment will be used for process step 226 shown in FIG. 5. As with the prior modules, fourth module 600 defines a clean room environment 610 which has ingress and egress through one or more portals or FOUTPs. For example, an in-portal or FOUP 612 receives a plurality of wafers for finish polishing. Wafers are removed from FOUP 612 and transferred by a transfer device 614 along a track 616 to a finish polisher 618. While two finish polishers 618 are depicted in FIG. 9, a larger or smaller number of polishers 618 may be used within the scope of the present invention.

Wafers are finish polished for about five (5) to six (6) minutes within finish polisher 618 in an embodiment. Wafers that have undergone finish polishing are transferred to a single wafer cleaner 630 by a transfer device 636. Again, transfer device 636 in one embodiment comprises a robot that travels along a track 638. After wafer cleaning at cleaner station 630, wafer metrology is again tested at a metrology station 640. In one embodiment, metrology processing within fourth module 600 uses a feedback loop to provide data to finish polishers 618 as a result of wafer metrology testing. In one embodiment, the feedback loop is of sufficiently short duration to permit adjustments to the finish polisher process prior to the polishing of the next wafer after the wafer being tested. Wafers which do not meet specification are placed in a reject FOUP or portal 642 for proper disposal. Wafers meeting specifications will be placed in an out-portal or FOUP 644 for subsequent processing, packaging and shipping.

Fourth module 600, in one embodiment, has a width 650 of about 14 feet 0 inches and a length 660 of about 16 feet 0 inches. In another embodiment, fourth module 600 has a footprint between about one hundred (100) square feet (sqft) and about one hundred and eighty (180) square feet. Again, as with all prior modules, the exact size may vary within the scope of the present invention. In one embodiment, fourth module 600 processes about thirty (30) wafers per hour. In another embodiment, fourth module 600 is adapted to process between about twenty-nine (29) and about thirty-three (33) 300 mm wafers per hour.

In one embodiment, the four modules 300, 400, 500 and 600, or their alternative embodiments, and ancillary equipment take up about 4,000 square feet or less of a production facility. This total footprint is much smaller than required for prior art equipment performing similar processes. As a result, apparatus, systems and methods of the present invention may be incorporated more readily in smaller facilities, or as part of a device fabrication facility in which circuit devices are formed. In this manner, the time and cost of packing and shipping, as well as unpacking and inspecting, are avoided. The costs of packing and shipping can, for example, save on the order of about two (2) percent or more of the total wafer processing costs.

The invention has now been described in detail for purposes of clarity and understanding. However, it will be appreciated that certain changes and modifications may be practiced within the scope of the appended claims. For example, the modules may have different layouts, dimensions and footprints than as described above.

What is claimed is:

1. A manifold for mixing chemistries, said manifold comprising:

a manifold interior chamber;

a premixing portion of said manifold interior chamber;

a plurality of inlets coupled with said premixing portion of said manifold interior chamber, said inlets each adapted to be coupled with a chemistry line, said premixing portion being disposed to premix chemistries;

a mixing element within said chamber;

an agitator coupled with said mixing element and adapted to agitate said mixing element so as to further mix said premixed chemistries; and an outlet coupled with a wafer polishing platen.

2. The manifold as in claim 1 wherein said mixing element comprises a generally cork screw shape.

3. The manifold as in claim 1 wherein said agitator is a translation device that is adapted to linearly translate said mixing element so as to further mix said premixed chemistries.

4. The manifold as in claim 1 wherein said agitator comprises a rotation device that is adapted to rotate said mixing element so as to further mix said premixed chemistries.

5. The manifold as in claim 1 wherein said agitator comprises a vibration device that is adapted to vibrate said mixing element so as to further mix said premixed chemistries.

6. The manifold as in claim 1 further comprising a chemistry tube coupled between said outlet and said platen for delivering said mixed chemistries to said platen.

7. An apparatus for mixing chemistries, said apparatus comprising:

a plurality of lines, wherein each of said lines is adapted to be coupled with a chemistry source;

a mixing manifold comprising a premixing portion, an outlet, and a plurality of inlets, each of said lines coupled with one of said inlets;

a mixing element operable within said manifold between said premixing portion and said outlet and being positioned such that chemistries introduced into said manifold at said inlets are premixed at said premixed portion and then pass said mixing element prior to reaching said outlet;

an agitator coupled with said mixing element and adapted to agitate said mixing element so as to further mix said premixed chemistries; and a pressure source operable to facilitate mixing of said chemistries in said mixing manifold.

8. The apparatus as in claim 7 wherein said mixing element is a mixing element having a generally cork screw shape.

9. The apparatus as in claim 7 further comprising a line coupled with said outlet and adapted to be coupled with a wafer polishing platen.

10. A method of mixing chemistries, said method comprising:

providing a manifold comprising an interior chamber having a premixing portion, and a plurality of inlets coupled with said premixing portion of said interior chamber, each of said inlets adapted to be coupled with a chemistry line;

introducing said chemistries into said premixing portion of said interior chamber so as to premix said chemistries;

agitating a mixing element operable within said interior chamber so as to further mix said premixed chemistries;

providing a pressure source, said pressure source operable to facilitate mixing of said chemistries in said interior chamber; and providing an outlet operable for coupling said interior chamber to a wafer polishing platen.

11. The method as in claim 10 wherein said agitating a mixing element comprises agitating a generally cork screw shape mixing element.

12. The method as in claim 10 wherein said agitating a mixing element comprises agitating a translation device that is adapted to linearly translate said mixing element so as to mix said premixed chemistries.

13. The method as in claim 10 wherein said agitating a mixing element comprises utilizing a rotation device that is adapted to rotate said mixing element so as to mix said premixed chemistries.

14. The method as in claim 10 wherein said agitating a mixing element comprises utilizing a vibration device that is adapted to vibrate said mixing element so as to mix said premixed chemistries.

15. The method as in claim 10 and further comprising coupling said outlet to said wafer polishing platen.

16. The method as in claim 10 wherein said interior chamber is substantially longer horizontally than it is vertically to promote premixing of said chemistries.

17. The method as in claim 10 wherein said mixing element operable within said interior chamber is not operable within said premixing portion of said interior chamber.

* * * * *